US007244109B2

(12) United States Patent
Park et al.

(10) Patent No.: US 7,244,109 B2
(45) Date of Patent: Jul. 17, 2007

(54) INSIDE FRAME OF COMPRESSOR

(75) Inventors: Seong Own Park, Changwon-si (KR); Hun Sik Lee, Changwon-si (KR); Young Jo Kim, Gimhae-si (KR); Yong Uk Son, Jinhae-si (KR); June Soo Hur, Changwon-si (KR); Ki Wook Song, Busan-si (KR)

(73) Assignee: LG Electronics Inc., Seoul (KR)

( * ) Notice: Subject to any disclaimer, the term of this patent is extended or adjusted under 35 U.S.C. 154(b) by 526 days.

(21) Appl. No.: 10/785,417

(22) Filed: Feb. 25, 2004

(65) Prior Publication Data

US 2005/0186090 A1 Aug. 25, 2005

(51) Int. Cl.
*F01B 23/08* (2006.01)
*F04B 17/00* (2006.01)
*F04B 35/00* (2006.01)

(52) U.S. Cl. ..... 417/321; 417/360; 417/902; 72/379

(58) Field of Classification Search ..... 417/360, 417/902, 321, 415; 72/379
See application file for complete search history.

(56) References Cited

U.S. PATENT DOCUMENTS 3,697,197 A * 10/1972 Berglund et al. ..... 417/360
4,566,865 A * 1/1986 Nishitsuji et al. ..... 417/363
4,808,085 A * 2/1989 Nishitsuji ..... 417/363
6,287,092 B1 * 9/2001 Calciolari et al. ..... 417/415
D455,641 S * 4/2002 Trifilio ..... D8/354
2005/0142007 A1 * 6/2005 Lee et al. ..... 417/415
2005/0142008 A1 * 6/2005 Jung et al. ..... 417/417
2005/0201875 A1 * 9/2005 Park ..... 417/417
2005/0214140 A1 * 9/2005 Lee et al. ..... 417/416
2006/0018771 A1 * 1/2006 Song et al. ..... 417/416
2006/0057000 A1 * 3/2006 Hyeon ..... 417/415

* cited by examiner

*Primary Examiner*—William H. Rodriguez
(74) *Attorney, Agent, or Firm*—Ked & Associates, LLP

(57) ABSTRACT

Inside frame of a compressor including a frame body having a pass through hole for a crankshaft, legs formed by bending, and extending from, opposite ends of the frame body, respectively, and component fastening parts formed by extending from the legs in parallel to the frame body, respectively, wherein the component fastening parts have opposite inward extensions, and the frame body is formed such that component fastening to the component fastening parts is possible without interference with the frame body, thereby minimizing a size of the compressor and enhancing an assembly precision and strength.

19 Claims, 7 Drawing Sheets

INSIDE FRAME OF COMPRESSOR

BACKGROUND OF THE INVENTION

1. Field of the Invention

The present invention relates to compressors for compressing a working fluid such as refrigerant to a required pressure, and more particularly, to an inside frame of a compressor inside of a shell of the compressor for mounting various components of the compressor thereon.

2. Background of the Related Art

The compressor compresses the working fluid, such as gas or a refrigerant, to a required pressure. In the compressors, there are turbo compressors, such as axial compressors, and centrifugal compressors, and displacement compressors, such as rotating compressors, and reciprocating compressors.

Of the compressors, the reciprocating compressor has a piston in a cylinder for reciprocating therein to draw gas or refrigerant into the cylinder, and compress, and discharge the gas or refrigerant.

FIG. 1 illustrates a section of a related art reciprocating compressor.

Referring to FIG. 1, the related art reciprocating compressor (hereafter called as a compressor) is provided with a shell 1 having an upper case 1*a* and a lower case 1*b*, for holding various components, and a frame 2 supported on springs 2S inside of the shell 1 for mounting various components of the compressor thereto.

There is a boss having a vertical pass through hole in a central part of the frame 2, with a crankshaft 5 rotatably mounted therein.

The crankshaft 5 has an oil passage 5*a*, for guiding oil L held in a bottom part of the shell 1 to an upper part of the shell, and spraying the oil onto the frame 2. There is a pumping mechanism 5*d* at a lower end of the crankshaft 5 for pumping the oil 'L' to the oil passage 5*a*.

The crankshaft 5 rotates by a motor part having a stator 3 and a rotor 4 fixed to the crankshaft 5 for rotating by an electrical interaction with the stator 3, under the frame.

There is a crank pin 5*b* on top of the crankshaft 5 eccentric from a rotation center of the crankshaft 5. There is a balance weight 5*c* opposite to the crank pin 5*b*, for making a rotation speed of the crankshaft 5 uniform.

In the meantime, there is a cylinder 6 formed as one unit with the frame 2 at one side of an upper part of the shell, with a compression chamber formed therein. There is a piston 7 in the cylinder for compression of refrigerant or gas, connected to the crank pin 5*b* at top of the crankshaft 5 with a connecting rod 8.

There is a valve assembly 9 on the cylinder 6 for controlling flow of refrigerant into/out of the compression chamber. The valve assembly 9 is provided with a suction valve for drawing refrigerant, and a discharge valve for discharging compressed refrigerant.

The valve assembly 9 is mounted between the cylinder 6 and the head cover 10, and there is a suction silencer 11 at one side of the head cover, connected to the valve assembly, for attenuating noise from the refrigerant.

The shell has one side having a suction pipe 12 fitted thereto for guiding the refrigerant from an outside of the compressor to the suction silencer 11, and the other side having a discharge pipe 13 for discharging compressed refrigerant.

Though the frame 2 is cast together with the boss 2*a*, the cylinder 6, and the like, the frame 2 may be fabricated separate from the boss 2*a* or the cylinder 6 and mounted on the frame depending on design conditions.

A structure of a related art frame for mounting the various components of the compressor will be described with reference to FIG. 2, wherein the boss, and the cylinder are fabricated separate from the frame.

Referring to FIG. 2, the frame is pressed or forged. The frame 20 is provided with an upper plate 21 having a boss hole in a central part for inserting a boss 24 therein, legs 22 bent downward, and extended from opposite ends of the upper plate 21, and stator fastening parts 23 bent outward, and extended perpendicular from lower ends of the legs 22 parallel to the upper plate 21.

Each of the stator fastening parts 23 has fastening holes 23*a* for fastening the stator 3 thereto which is mounted on an underside of the stator fastening parts 23 with fastening means 3*a*.

However, the related art frame has the following problems.

First, the stator fastening parts 23 of the frame 20 formed by outward bending, and extension from the legs 16 results in a long total length 'L' of the frame 20, that impedes fabrication of a smaller compressor.

Second, the contact of an entire bottom surface of the flange 24*a* formed at a top of the boss 24 with an edge of the boss hole is liable to cause the boss and the upper plate 21 to misalign so as to be out of a right angle, that impedes smooth rotation of the crankshaft inserted in the boss 24.

Third, the low rigidity of the bent parts 22*a* and 22*b* of the frame is liable to cause breakage, or deformation due to stress concentration.

Fourth, in a case of deformation of the frame, relative positions of components mounted on the frame change, to make a performance of the compressor poor.

SUMMARY OF THE INVENTION

Accordingly, the present invention is directed to an inside frame of a compressor that substantially obviates one or more of the problems due to limitations and disadvantages of the related art.

An object of the present invention is to provide an inside frame of a compressor, which can minimize a size of the compressor.

Other object of the present invention is to provide an inside frame of a compressor, in which assembly precision of a boss which supports a crankshaft, and a frame body the boss is fixed thereto, is enhanced, for making crankshaft rotation smooth.

Another object of the present invention is to provide an inside frame of a compressor, deformation or breakage of which is prevented during operation of the compressor.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the inside frame of a compressor includes a frame body having a pass through hole for a crankshaft, legs formed by bending, and extending from, opposite ends of the frame body respectively, and component fastening parts formed by extending from the legs in parallel to the frame body, respectively, wherein the component fastening parts have opposite inward extensions, and the frame body is formed such that component fastening to the component fastening parts is possible without interference with the frame body.

The legs are bent in predetermined widths at middle parts of the opposite ends of the frame body respectively, and the component fastening parts are provided at width direction opposite sides of each of the legs. The component fastening part has fastening holes for fastening a component.

The frame body has parts over the fastening holes cut away for making the fastening holes visible from above.

The inside frame further includes a seating part bent outward from each of the legs for seating the component fastened to the component fastening parts thereon.

The seating part includes stoppers at outer edges thereof for preventing movement of the frame body, for preventing the component mounted on the inside frame from hitting an inside wall of the shell during operation of the compressor.

Preferably, the seating part is formed not longer than a side of the frame body at which the leg is formed.

The frame body includes a boss inserted in, and held at, the pass through hole, for rotatably supporting the crankshaft.

The boss includes a flange perpendicular to an axis direction of the crankshaft.

The frame body further includes an annular recess in a part the flange of the boss is seated thereon.

The boss is fixed with fixing holes formed in one the flange of the boss, and the annular recess, and projections formed in the other one of the flange and the annular boss.

Preferably, the projection includes a round part to have a curvature at a lower part thereof for preventing breakage or deformation of the projection.

The projection is cylindrical, and the round part has a radius of curvature greater than a 0.05 time of a diameter of the projection.

The flange of the boss or the annular recess includes a flange supporting part having predetermined width and height to form a step.

The projection may include a flange supporting part having predetermined width and height around a lower part thereof.

In formation of the projection, a predetermined pressure is applied to an opposite surface to a surface the projection is to be projected therefrom to sink the opposite surface to a predetermined depth.

The inside frame further includes at least one reinforcing rib at each bent part of the legs or the component fastening part.

The reinforcing rib is formed such that, by applying a predetermined pressure to one side of the bent part, one side having the pressure applied thereto is collapsed, and an opposite side is projected.

The reinforcing rib is formed by applying the predetermined pressure to an outward curved part of the bent part, to project the opposite side.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

In describing the reciprocating compressor having the inside frame of a compressor of the present invention applied thereto, since parts except the parts described hereafter are identical, description of the identical parts will be omitted for convenience sake. The embodiments of the inside frame of a compressor of the present invention will be described with reference to the attached drawings FIGS. 3 to 7.

Figure 1:
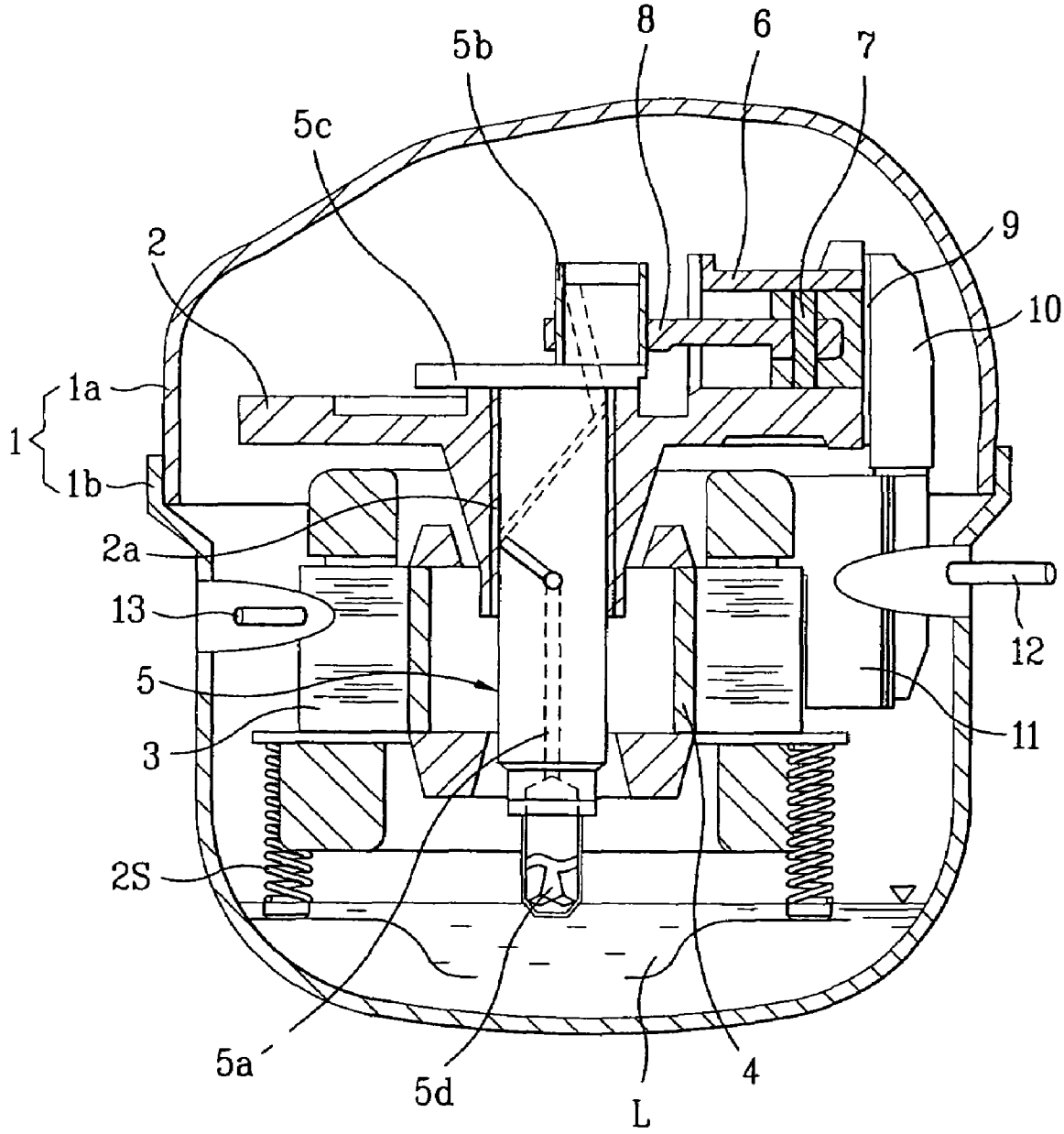
FIG. 1 BACKGROUND ART
FIG. 1 illustrates a section of a related art reciprocating compressor.
Figure 2:
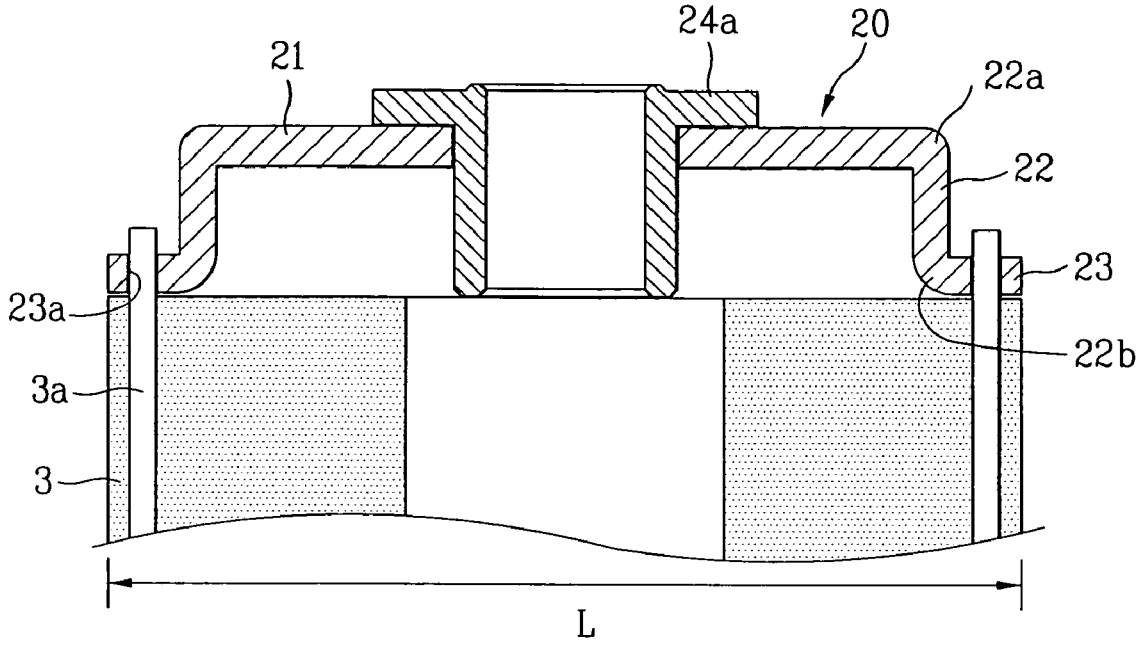
FIG. 2 BACKGROUND ART
FIG. 2 illustrates a section of an inside frame of the compressor in FIG. 1.
Figure 3A:
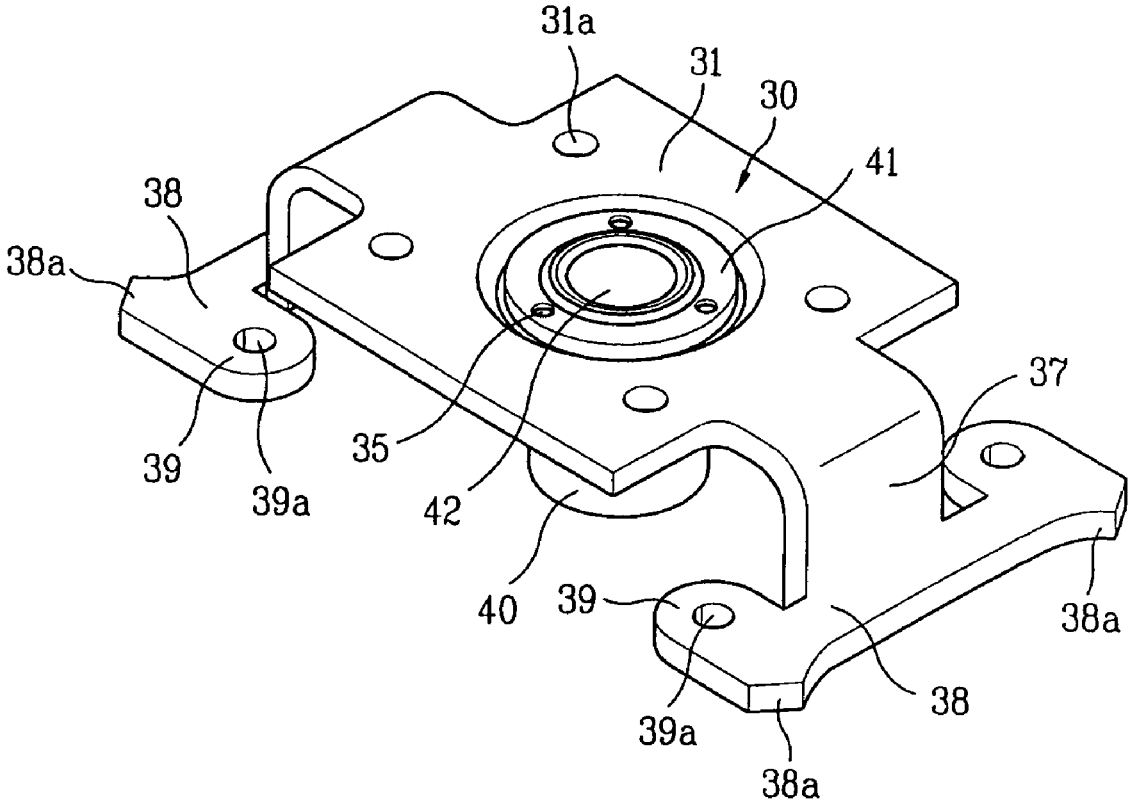
FIGS. 3A, 3B, and 3C respectively illustrate a perspective view, and a developed view and a plan view, both having a boss detached therefrom, of an inside frame of a compressor in accordance with a preferred embodiment of the present invention.
Figure 3B:
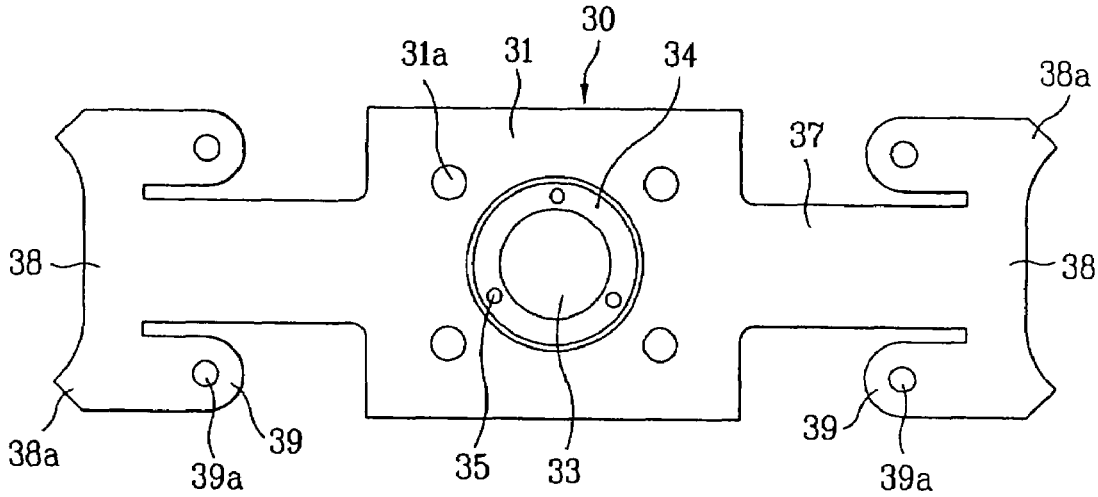
Figure 3C:
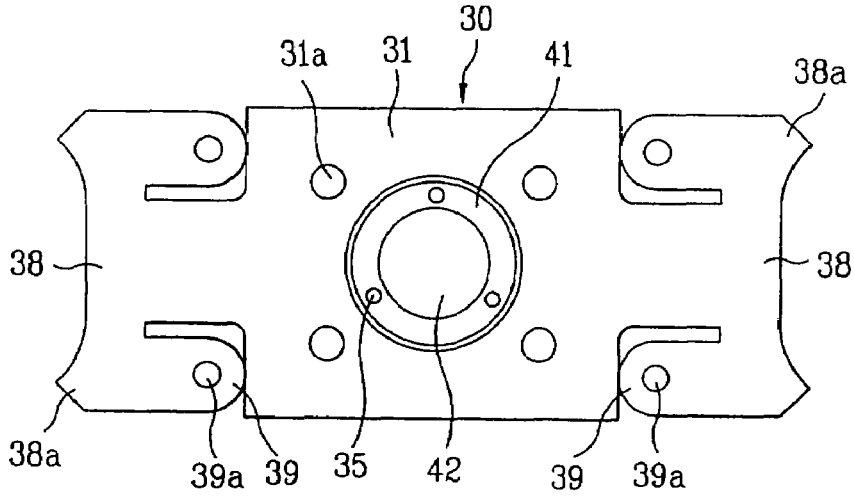

Of the attached drawings, FIGS. 3A, 3B, and 3C respectively illustrate a perspective view, and a developed view and a plan view, both having a boss detached therefrom, of an inside frame of a compressor in accordance with a preferred embodiment of the present invention.

Referring to FIGS. 3A and 3B, the inside frame 30 of a compressor in the compressor for mounting various components of the compressor thereon includes a frame body 31, legs 37 at opposite sides of the frame body, and component fastening parts 39.

The frame body 31, fabricated with a steel plate of a thickness, has a vertical pass through hole 33 for a crankshaft which reciprocates a piston, linearly. There is a boss 40 inserted in the pass through hole 33 in the frame body for rotatably supporting the crankshaft.

The legs 37 are bent downward from opposite ends of the frame body 31 respectively, for supporting the frame body 31. In more detail, the legs 37 are bent downward from middle parts of opposite ends of the frame body 31, each with a predetermined width.

The component fastening parts 39, parts for fastening components, such as a stator, extend inward from respective legs 37 opposite to each other, such that the component fastening parts 139 are parallel to the upper surface of the frame body 31. In more detail, the component fastening part 39 extends inward from width direction opposite side parts of each of the legs 37, and the component fastening part 39 has the fastening holes 39*a* for fastening components.

It is preferable that, in order to make a part of the component fasting part 39 the fastening hole 39*a* are formed therein visible from above, corners of the frame body 31 which comes over the fasting holes are cut away, so that, when a tool, such as a punch, accesses for fastening component, such as the stator, or forming a fastening hole in the component fastening part, the tool does not interfere with the frame body.

It is preferable that the inside frame of the compressor includes seating parts 38 each bent outward from each leg 37 for seating the component fastened to the component fastening part 39, additionally. The seating part 38 is formed as one unit with the component fastening part 39 on the same plane with the component fastening part 39.

It is preferable that the seating part 38 is parallel with an upper surface of the frame body 31, and has a length not greater than a width of a frame body 31 side at which the leg 37 is formed.

It is preferable that the seating part 38 has stoppers 38*a* extended outward from outer edges thereof in an outer direction of the leg 37, for preventing the component mounted on the inside frame from hitting an inside wall of the shell due to vibration during operation of the compressor.

An unexplained reference symbol 31*a* denotes an upper fastening hole for fastening a cylinder (not shown) or the like to the frame body 31.

Next, the frame body 31 having the pass through hole 33 formed therein, and the boss 40 inserted in, and held at the pass through hole will be described, with reference to FIGS. 4, 5A, and 5B.

Figure 4:
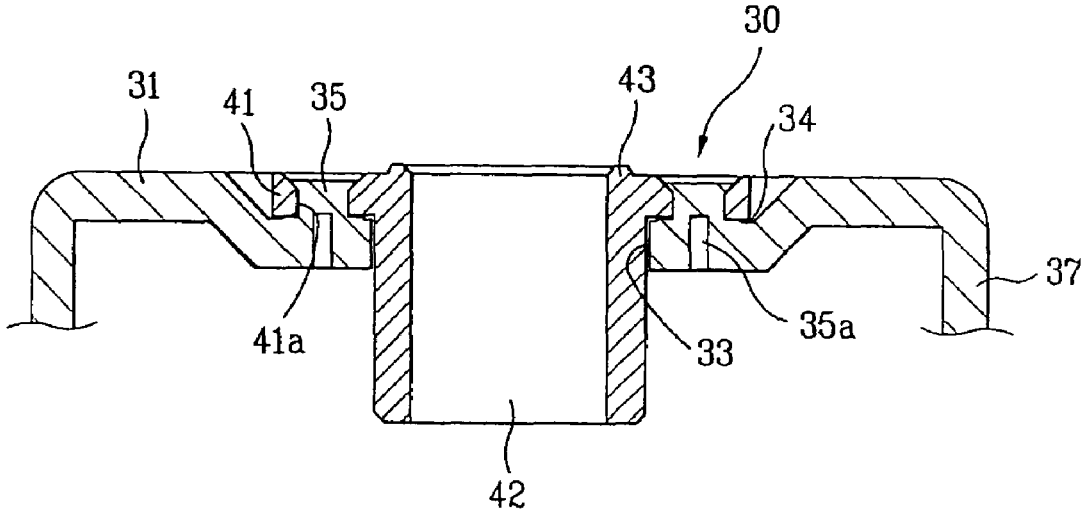
FIG. 4 illustrates a section of a frame body in an inside frame of a compressor in accordance with a first preferred embodiment of the present invention.
Figure 5A:
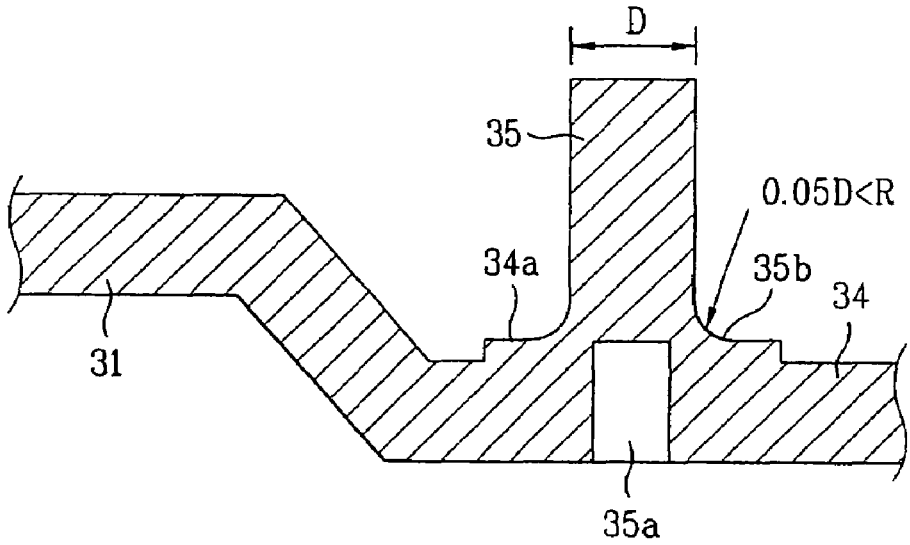
FIGS. 5A and 5B respectively illustrate a section and a plan view of a holding projection provided to the inside frame of a compressor in accordance with a first preferred embodiment of the present invention.
Figure 5B:
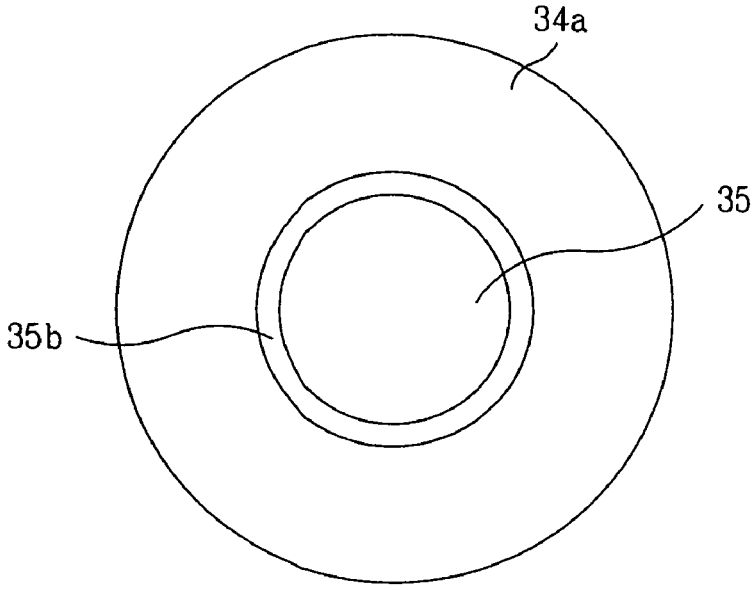

Referring to FIGS. 4, 5A, and 5B, the boss 40 is a length of cylinder, having a pass through hole 42 along an axis direction, for rotatably arranging the crankshaft therein.

The boss includes a thrust part 43 at a top end thereof for rotatably supporting an underside of the balance weight of the crankshaft, and a flange 41 at the top end thereof formed perpendicular to the axis of boss for seating the boss on an upper surface of the frame body, particularly, on an edge of the pass through hole.

It is preferable that the thrust part 43 is projected more than the upper surface of the frame body 31 slightly, for preventing parts, such as the balance weight of the crankshaft supported on the thrust part 43 from being brought into contact with the flange 41 or the frame body 31.

The frame body 31 has an annular recess 34 lower than the upper surface of the frame body 31 around the pass through hole 33 the flange 41 of the boss is seated thereon.

For fixing the boss, the annular recess has a plurality of projections 35 of bars, and the flange 41 on the boss has a plurality of fixing holes 41*a* for inserting the projections 35.

The projections 35 may be formed by different methods, such as forging or pressing. There is a hole 35*a* sunken into a depth in a lower surface of the frame body 31, i.e., in an opposite surface of the surface the projection 35 is projected therefrom by a pressure applied in a projection direction of the projection 35 in formation of the projection 35.

The hole 35*a* is formed for smoother formation of the projection 35, i.e., the pressure applied for forming the hole 35*a* pushes the lower surface of the frame body 31, to assist forming the projection 31.

The formation of the holes 35*a* under the projections 35 liable to make strength of the annular recess weaker as a lower part of the projection 35 becomes relatively less thick. For preventing breakage of the projection 35 due to the weaker strength, it is preferable that the projection 35 has a round part 35*b* at a lower part thereof.

The round part 35*b* reinforces a part that connects the lower part of the projection 35 to the annular recess 34. It is preferable that the round part 35*b* has a radius 'R' of curvature greater than a 0.05 times of the diameter 'D' of the projection 35, for reinforcing the part connecting the lower part of the projection 35 and the annular recess 34 with a thickness greater than a certain thickness.

Of course, the round part 35*b* may be formed in the lower part of the projection even in a case no hole 35*a* is formed in the lower surface of the frame body 31 for smooth formation of the projection, for prevention of breakage of the projection 35.

Though the embodiment suggests forming the projection 35 on the annular recess of the frame body 31 and the fixing hole 41*a* in the flange 41 of the boss 40, the projection 35 and the fixing hole 41*a* may be formed, oppositely.

The projection 35 includes a flange supporting part 34*a* around the projection 35, with a height from a surface of the annular recess 34 to form a step 37. That is, the flange supporting part 34*a* is formed at a height from the surface of the annular recess 34, for seating a lower surface of the flange 40 of the boss 40.

The flange supporting part 34*a* makes a contact area between the flange 41 and the frame body 31 to be minimum, and facilitating that the axis of the pass through hole 42 of the boss 40 is perpendicular to the upper surface of the frame body 31 accurately, and minimizing friction of the crankshaft in the boss 40.

In the inside frame of the compressor in accordance with the first preferred embodiment of the present invention, though the flange supporting part 34*a* has a circular horizontal sectional area, the form is not limited to circle.

In addition to this, it is preferable that reinforcing ribs are formed in upper and lower parts of the legs 37 respectively, i.e., in a bent part connected to the frame body 31, and in a bent part connected to the seating part 39, respectively. A second embodiment of the present invention having the reinforcing ribs is illustrated in FIGS. 6 and 7.

Figure 6:
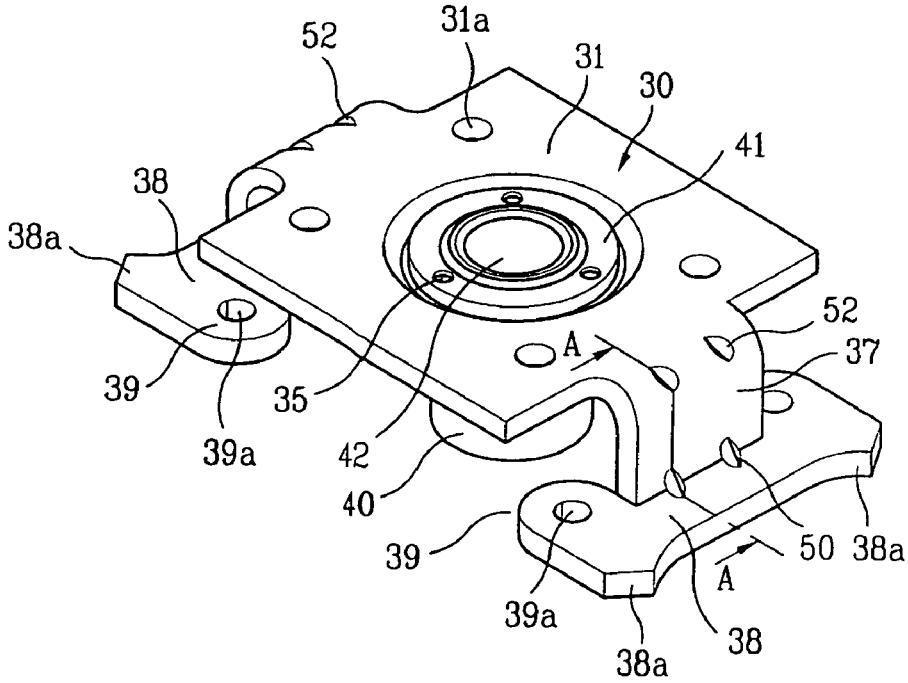
FIG. 6 illustrates a perspective view of an inside frame of a compressor in accordance with a second preferred embodiment of the present invention.
Figure 7:
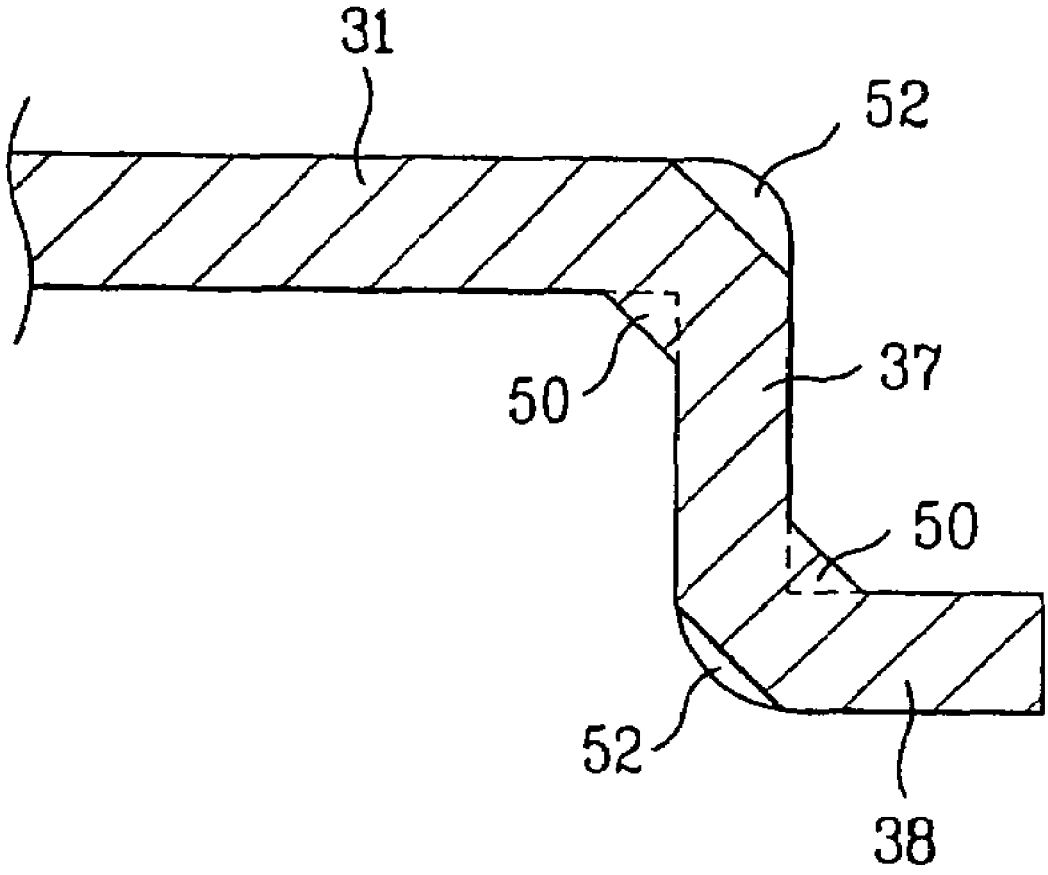
FIG. 7 illustrates a section of a bent part along a line A-A in FIG. 6.

Referring to FIGS. 6 and 7, the reinforcing ribs 50 in the bent parts of the inside frame 30 of the compressor are formed together with the inside frame. It is preferable that the reinforcing ribs 50 are formed in an extension direction of the legs 37.

That is, reinforcing rib 50 is formed by applying a pressure to the bent parts in the upper and lower parts of the legs 37 with a punch of a required form. Though the punch may have a polygonal bar section, the section is not limited to the polygonal bar section.

Upon applying the pressure to the upper or lower bent part of the leg 37 with the punch of above form, the reinforcing ribs 50 are formed at a side opposite to a side having the pressure applied thereto, and collapsed recesses 52 are formed at the side having the pressure applied thereto with the punch.

The reinforcing ribs 50 prevent deformation or breakage of the inside frame of the compressor due to vibration or the like occurred in operation of the compressor.

A process for fabricating the inside frame of the compressor of the present invention, and operation thereof will be described, in detail.

The inside frame of a compressor of the present invention has a structure, in which the boss 40 is fabricated separate from the frame body 31, and mounted on the frame body 31. The inside frame 30 is pressed or forged with a sheet of steel plate, of which exemplary process will be described.

Referring to FIG. 3B, a sheet of plate cut in required length and width is cut into a designed form. The cut plate is bent to have a form having the legs 37, the component fastening parts 39, and the seating parts 38. Of course, the cutting and bending may be carried out in one fabrication process.

Though the processes of cutting, bending, and hole making may be carried Out at the same time, or changing the order, it is preferable that a process on a surface of the inside frame 30, such as the hole making of the fastening holes is progressed after completion of a form of the inside frame 30.

For forming the fastening holes 39*a* in the surface of the component fastening parts 39 for fastening the stator, it is required that the tool for forming the fastening hole 39*a* does not interfere with the frame body 31. For this, it is required that corners of the frame body 31 are cut away such that the component fasting parts 39 are visible from above.

The frame body cut thus is joined with the boss 40 having the flange 41 with the fixing holes 41*a* and the projections 35.

The inside frame 30 of a compressor fabricated thus is mounted on an inside of the shell and joined with various components of the compressor. In the components mounted on the inside frame 30, there are the piston with the cylinder fitted therein, the stator, the crankshaft, and the like. That is, the cylinder is mounted on the upper surface of the frame body 31, the stator is fastened to the component fastening parts 39, and the crankshaft is mounted passed through the boss 40. As the rotor is pressed into, and fixed on, the crankshaft that interacts with the stator electro-magnetically, the compressor can carry out the function of compressing the low pressure refrigerant and discharging at a high pressure.

The inside frame of the compressor and a compressor therewith have the following advantages.

First, the inward extension of the fastening parts permits to reduce a volume of the inside frame, thereby reducing a size of the compressor.

Second, the cutting away of the corners of the frame body, for preventing interference with the frame body in formation of the fastening holes in the component fastening parts or fastening the component, such as the stator, enables easy formation of the fastening holes, and easy fastening of the components.

Third, the annular recess around the pass through hole in the frame body for seating the flange reduces a vertical length of the compressor, thereby reducing a size of the compressor.

Fourth, the pushing up of the lower surface of the frame body with a predetermined pressure for forming the projection from the annular recess permits an easy formation of the projection of a height.

Fifth, the flange supporting part for minimizing a contact area between the flange of the boss, and the flange body enhances a fitting precision between the frame body and the boss.

Sixth, the reinforcing ribs in the bent parts in the upper part and the lower part of the legs, and the round part in the lower part of the projection prevent deformation or breakage of the frame.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An inside frame of a compressor comprising:

a frame body having a pass through hole for a crankshaft;

legs formed by bending, and extending from, opposite ends of the frame body, respectively; and component fastening parts formed by extending from the legs in parallel to the frame body, respectively, wherein the component fastening parts have opposite inward extensions, and the frame body is formed such that component fastening to the component fastening parts is possible without interference with the frame body.

2. The inside frame as claimed in claim 1, wherein the legs are bent in a predetermined widths at middle parts of the opposite ends of the frame body respectively, and the component fastening parts are provided at width direction opposite sides of each of the legs.

3. The inside frame as claimed in claim 2, wherein the component fastening part has fastening holes for fastening a component.

4. The inside frame as claimed in claim 3, wherein the frame body has parts over the fastening holes cut away for making the fastening holes visible from above.

5. The inside frame as claimed in claim 1, further comprising a seating part bent outward from each of the legs for seating the component fastened to the component fastening parts thereon.

6. The inside frame as claimed in claim 5, wherein the seating part includes stoppers at outer edges thereof for preventing movement of the frame body, for preventing the component mounted on the inside frame from hitting an inside wall of the shell during operation of the compressor.

7. The inside frame as claimed in claim 5, wherein the seating part is formed not longer than a side of the frame body at which the leg is formed.

8. The inside frame as claimed in claim 1, wherein the frame body includes a boss inserted in, and held at, the pass through hole, for rotatably supporting the crankshaft.

9. The inside frame as claimed in claim 8, wherein the boss includes a flange perpendicular to an axis direction of the crankshaft.

10. The inside frame as claimed in claim 9, wherein the frame body further includes an annular recess in a part the flange of the boss is seated thereon.

11. The inside frame as claimed in claim 10, wherein the boss is fixed with fixing holes formed in one the flange of the boss, and the annular recess, and projections formed in the other one of the flange and the annular boss.

12. The inside frame as claimed in claim 11, wherein the projection includes a round part to have a curvature at a lower part thereof for preventing breakage or deformation of the projection.

13. The inside frame as claimed in claim 12, wherein the projection is cylindrical, and the round part has a radius of curvature greater than a 0.05 time of a diameter of the projection.

14. The inside frame as claimed in claim 10, wherein the flange of the boss or the annular recess includes a flange supporting part having predetermined width and height to form a step.

15. The inside frame as claimed in claim 11, wherein the projection includes a flange supporting part having predetermined width and height around a lower part thereof.

16. The inside frame as claimed in claim 11, wherein, in formation of the projection, a predetermined pressure is applied to an opposite surface to a surface the projection is to be projected therefrom to sink the opposite surface to a predetermined depth.

17. The inside frame as claimed in claim 1, further comprising at least one reinforcing rib at each bent part of the legs or the component fastening part.

18. The inside frame as claimed in claim 17, wherein the reinforcing rib is formed such that, by applying a predetermined pressure to one side of the bent part, one side having the pressure applied thereto is collapsed, and an opposite side is projected.

19. The inside frame as claimed in claim 18, wherein the reinforcing rib is formed by applying the predetermined pressure to an outward curved part of the bent part, to project the opposite side.

* * * * *